US006888112B2

(12) United States Patent
Rock et al.

(10) Patent No.: US 6,888,112 B2
(45) Date of Patent: May 3, 2005

(54) ELECTRIC HEATING/WARMING WOVEN FIBROUS ARTICLES

(75) Inventors: Moshe Rock, Andover, MA (US); Vikram Sharma, Stoneham, MA (US)

(73) Assignee: Malden Hills Industries, Inc., Lawrence, MA (US)

( * ) Notice: Subject to any disclaimer, the term of this patent is extended or adjusted under 35 U.S.C. 154(b) by 355 days.

(21) Appl. No.: 10/082,465

(22) Filed: Feb. 25, 2002

(65) Prior Publication Data

US 2002/0104837 A1 Aug. 8, 2002

Related U.S. Application Data

(60) Continuation-in-part of application No. 09/791,237, filed on Feb. 23, 2001, and a continuation-in-part of application No. 09/703,089, filed on Oct. 31, 2000, now Pat. No. 6,307,189, which is a continuation-in-part of application No. 09/697,100, filed on Oct. 26, 2000, now Pat. No. 6,373,034, and a continuation-in-part of application No. 09/592,235, filed on Jun. 12, 2000, which is a division of application No. 09/468,627, filed on Dec. 21, 1999, now Pat. No. 6,215,111, which is a continuation-in-part of application No. 09/395,326, filed on Sep. 13, 1999, now Pat. No. 6,160,246, which is a division of application No. 09/296,375, filed on Apr. 22, 1999, now abandoned.

(51) Int. Cl.[7] ..... H05B 3/54

(52) U.S. Cl. ..... 219/545; 219/211; 219/212; 219/529; 66/170

(58) Field of Search ..... 219/545, 211, 219/212, 213, 527, 528, 529, 542, 543, 549; 29/91, 91.1; 66/170, 171, 191, 192, 194, 195; 428/89

(56) References Cited

U.S. PATENT DOCUMENTS 975,359 A 11/1910 Hefter (Continued)

FOREIGN PATENT DOCUMENTS

DE 2 251 207 5/1974

(Continued)

OTHER PUBLICATIONS

European Search Report for EP Appln. No. 03251059.6 mailed Apr. 24, 2003 (4 pp).

*Primary Examiner*—Fadi H. Dahbour
(74) *Attorney, Agent, or Firm*—Fish & Richardson P.C.

(57) ABSTRACT

A woven fibrous article that generates heat upon application of electrical power has a woven fibrous body consisting of a set of non-conductive warp yarns and a set of non-conductive filling or weft yarns. One of the set of non-conductive warp yarns and the set of non-conductive filling or weft yarns, in one or more first regions, consists of relatively more coarse yarns and in one or more second regions consists of relatively more fine yarns with electrical conductor elements extending generally along the second regions of the woven fibrous body to connect the plurality of spaced apart electrical conductance heating elements in a parallel electrical circuit to a source of electrical power. The other of the set of non-conductive warp yarns and the set of non-conductive filling or weft yarns, in the one or more first regions and in the one or more second regions, consists of relatively more fine yarns, with a plurality of spaced apart electrical conductance heating elements in the form of conductive elements joined in the woven fibrous body with the other of the set of non-conductive warp yarns and the set of non-conductive filling or weft yarns to extend generally between opposite the second regions of the woven fibrous body. In one embodiment, fleece may be formed on one or both surfaces of the woven fibrous body by finishing fibers of the relatively more coarse yarns in the one or more first regions of the set of non-conductive warp yarns or non-conductive filling or weft yarns, in a manner to avoid damage to electrical conductivity performance of the conductive elements joined with the set of yarns of the woven fibrous body. A method of forming a woven fibrous article of the invention is also described.

55 Claims, 9 Drawing Sheets

U.S. PATENT DOCUMENTS

| | | | | | |
|---|---|---|---|---|---|
| 1,456,223 | A | | 5/1923 | Craddick et al. | |
| 1,553,461 | A | | 9/1925 | Negromanti | |
| 1,744,327 | A | | 1/1930 | Moore | |
| 1,965,542 | A | | 7/1934 | Colvin, Jr. | |
| 2,025,586 | A | | 12/1935 | Hall | |
| 2,203,918 | A | | 6/1940 | Moberg | |
| 2,381,218 | A | | 8/1945 | Jacob | |
| 2,392,470 | A | | 1/1946 | Fitzmaurice | |
| 2,432,785 | A | | 12/1947 | Moberg | |
| 2,458,801 | A | | 1/1949 | Schwartz | |
| 2,581,212 | A | | 1/1952 | Spooner, Jr. | |
| 2,670,620 | A | | 3/1954 | Goldstaub | |
| 2,862,097 | A | | 11/1958 | Negromanti | |
| 2,945,115 | A | | 7/1960 | Weitzel | |
| 3,425,020 | A | | 1/1969 | Toyooka et al. | |
| 3,472,289 | A | | 10/1969 | Webber et al. | |
| 3,478,422 | A | | 11/1969 | Inui | |
| 3,513,297 | A | | 5/1970 | Jordan | |
| 3,528,874 | A | | 9/1970 | Spencer | |
| 3,683,151 | A | * | 8/1972 | Mills et al. | 219/212 |
| 3,721,799 | A | | 3/1973 | Carlstrom | |
| 3,859,506 | A | | 1/1975 | Weckstein | |
| 4,021,640 | A | | 5/1977 | Gross et al. | |
| 4,063,069 | A | | 12/1977 | Perri | |
| 4,139,763 | A | * | 2/1979 | McMullan et al. | 219/528 |
| 4,245,149 | A | | 1/1981 | Fairlie | |
| 4,250,397 | A | | 2/1981 | Gray et al. | |
| 4,358,668 | A | * | 11/1982 | McMullan et al. | 219/528 |
| 4,375,009 | A | | 2/1983 | Fearnside et al. | |
| 4,398,462 | A | | 8/1983 | Okano | |
| 4,430,560 | A | * | 2/1984 | Mills et al. | 219/212 |
| 4,459,461 | A | | 7/1984 | Spencer | |
| 4,481,881 | A | | 11/1984 | Okano | |
| 4,523,086 | A | | 6/1985 | Eilentropp | |
| 4,533,821 | A | | 8/1985 | Sato | |
| 4,538,054 | A | | 8/1985 | De la Bretoniere | |
| 4,564,745 | A | | 1/1986 | Deschenes | |
| 4,577,094 | A | | 3/1986 | Mills | |
| 4,607,154 | A | | 8/1986 | Mills | |
| 4,626,657 | A | * | 12/1986 | Endo et al. | 219/212 |
| 4,656,334 | A | | 4/1987 | Endo et al. | |
| 4,713,531 | A | | 12/1987 | Fennekels et al. | |
| 4,736,088 | A | | 4/1988 | Bart | |
| 4,792,662 | A | | 12/1988 | Kitagaki et al. | |
| 4,983,814 | A | | 1/1991 | Ohgushi et al. | |
| 5,073,688 | A | | 12/1991 | McCormack | |
| 5,081,341 | A | | 1/1992 | Rowe | |
| 5,298,722 | A | | 3/1994 | Tanaka | |
| 5,319,950 | A | | 6/1994 | Whitt et al. | |
| 5,321,960 | A | | 6/1994 | Whitt et al. | |
| 5,364,678 | A | | 11/1994 | Lumb et al. | |
| 5,412,181 | A | | 5/1995 | Giamati | |
| 5,422,462 | A | | 6/1995 | Kishimoto | |
| 5,484,983 | A | | 1/1996 | Roell | |
| 5,573,687 | A | | 11/1996 | Tanaka | |
| 5,582,757 | A | | 12/1996 | Kio et al. | |
| 5,679,277 | A | | 10/1997 | Niibe et al. | |
| 5,837,971 | A | * | 11/1998 | Lee | 219/212 |
| 5,858,530 | A | | 1/1999 | McCullough, Jr. | |
| 5,918,319 | A | | 7/1999 | Baxter | |
| 5,977,517 | A | | 11/1999 | Grosjean | |
| 6,160,246 | A | | 12/2000 | Rock et al. | |
| 6,175,098 | B1 | * | 1/2001 | Kim et al. | 219/212 |
| 6,242,713 | B1 | * | 6/2001 | Kim et al. | 219/212 |
| 6,300,597 | B1 | * | 10/2001 | Lee | 219/212 |
| 6,307,189 | B1 | | 10/2001 | Rock et al. | |

FOREIGN PATENT DOCUMENTS

| | | |
|---|---|---|
| DE | 197 45 889 A1 | 4/1999 |
| DE | 299 01 225 | 5/1999 |
| EP | 0 548 574 A2 | 6/1993 |
| FR | 2 740 934 | 5/1997 |
| GB | 1 205 800 | 9/1970 |
| GB | 2 110 909 | 6/1983 |

OTHER PUBLICATIONS

European Search Report Patent Application No. 01309096.4 dated Apr. 3, 2002 (2 pages).

* cited by examiner

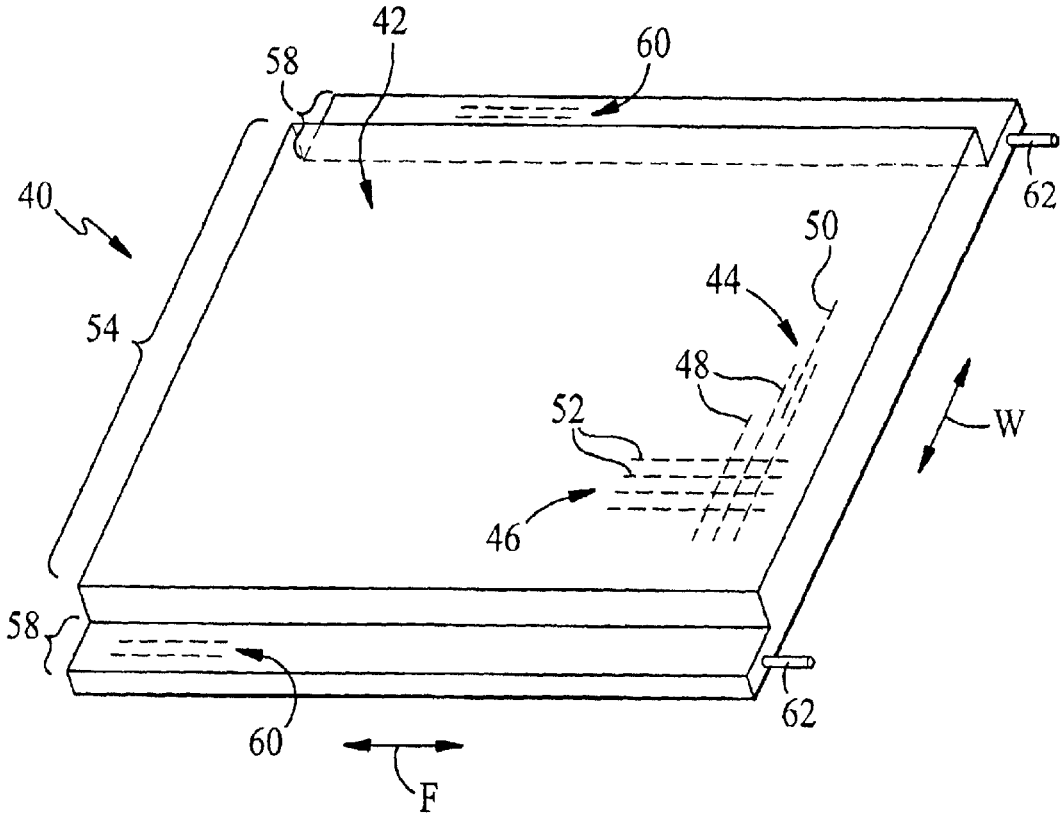
FIG. 5
FIG. 6A
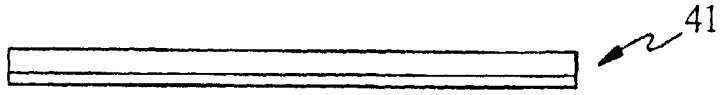
FIG. 6B
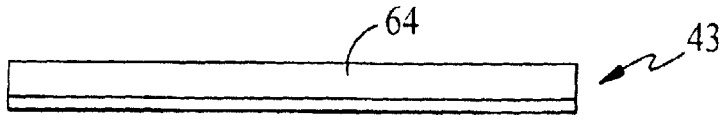
FIG. 6C
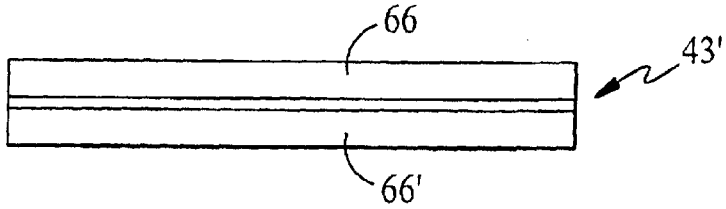

ELECTRIC HEATING/WARMING WOVEN FIBROUS ARTICLES

TECHNICAL FIELD

This application is: a continuation-in-part of U.S. application Ser. No. 09/791,237, filed Feb. 23, 2001, now pending, which is a continuation-in-part of U.S. application Ser. No. 09/697,100, filed Oct. 26, 2000, now U.S. Pat. No. 6,373,034, which is a continuation-in-part of U.S. application Ser. No. 09/395,326, filed Sep. 13, 1999, now U.S. Pat. No. 6,160,246, issued Dec. 12, 2000, which is a division of U.S. application Ser. No. 09/296,375, filed Apr. 22, 1999, now abandoned and is a continuation-in-part of U.S. application Ser. No. 09/592,235, filed Jun. 12, 2000, now pending; and a continuation-in-part of U.S. application Ser. No. 09/703,089, filed Oct. 31, 2000, now U.S. Pat. No. 6,307,189, issued Oct. 23, 2001, which is a division of U.S. application Ser. No. 09/468,627, filed Dec. 21, 1999, now U.S. Pat. No. 6,215,111, issued Apr. 10, 2001; the complete disclosures of all of which are incorporated herein by reference.

The invention relates to woven, fibrous fabric articles that generate heat/warmth upon application of electricity.

BACKGROUND

Fabric or fibrous heating/warming articles are known, e.g., in the form of electric blankets, heating and warming pads and mats, heated garments, and the like. Typically, these heating/warming articles consist of a body defining one or a series of envelopes or tubular passageways into which electrical conductance heating wires or elements have been inserted. In some instances, the electric conductance heating wires are integrally incorporated into the body during its formation, e.g. by weaving or knitting. Relatively flexible electric conductance heating wires or elements, e.g., in the form of a core of insulating material, e.g., yarn, about which is disposed an electrical conductive element, e.g., a helically wrapped metal wire or an extruded sheath of one or more layers of conductive plastic, have been fabricated directly into the woven or knitted structure of a fabric body. For example, in Kishimoto U.S. Pat. No. 5,422,462, conductive yarns are selectively substituted for warp and/or weft yarns during formation of a woven body. The conductive yarns are then connected at their ends to a source of electrical current.

SUMMARY

According to one aspect of the invention, a woven fibrous article adapted to generate heat upon application of electrical power comprises a woven fibrous body comprising a set of non-conductive warp yarns and a set of non-conductive filling or weft yarns, one of the set of non-conductive warp yarns and the set of non-conductive filling or weft yarns in one or more first regions comprising relatively more coarse yarns and in one or more second regions comprising relatively more fine yarns with electrical conductor elements extending generally along the second regions of the woven fibrous body, and the other of the set of non-conductive warp yarns and the set of non-conductive filling or weft yarns in the one or more first regions and in the one or more second regions comprising relatively more fine yarns, with a plurality of spaced apart electrical conductance heating elements in the form of conductive elements joined in the woven fibrous body with the other of the set of non-conductive warp yarns and the set of non-conductive filling or weft yarns to extend generally between opposite second regions of the woven fibrous body, the conductor elements being adapted to connect the plurality of spaced apart electrical conductance heating elements in a parallel electrical circuit to a source of electrical power.

Preferred embodiments of this aspect of the invention may include one or more of the following additional features. The woven fibrous article has fleece upon at least one surface of the woven fibrous body, formed by finishing fibers of the relatively more coarse yarns in the one or more first regions of the one of the set of non-conductive warp yarns and the set of non-conductive filling or weft yarns in a manner to avoid damage to electrical conductivity performance of the electrical conductance heating elements joined with the other of the set of non-conductive warp yarns and the set of non-conductive filling or weft yarns of the woven fibrous body. The woven fibrous body has fleece formed in the relatively more coarse non-conductive fibers upon one surface or upon both surfaces. In the one or more first regions, the set of non-conducting warp yarns comprises the relatively more coarse yarns and the set of non-conducting filling or weft yarns comprises the relatively more fine yarns. Preferably, the one or more second regions comprises selvedge or edge regions. Alternatively, in one or more first regions, the set of non-conducting filling or weft yarns comprises the relatively more coarse yarns and the set of non-conducting warp yarns comprises the relatively more fine yarns. Preferably, the one or more second regions comprises spaced regions with one or more first regions disposed therebetween. The one or more second regions comprises a plurality of spaced second regions with one or more first regions disposed therebetween. A series of at least three electrical conductance heating elements of the plurality of electrical conductance heating elements are symmetrically spaced. Selected of the electrical conductance heating elements are asymmetrically spaced to provide selected localized regions of heating. Selected of the conductive elements have relatively lower linear resistance than other of the conductive elements, to provide selected localized regions of relatively greater heating. Selected of the conductive elements of relatively lower linear resistance are symmetrically spaced and/or asymmetrically spaced. The conductive elements have the form of a conductive yarn. The fibrous body comprises hydrophilic material and/or hydrophobic material. The electrical conductor elements are adapted for connecting the plurality of spaced-apart electrical conductance heating elements in the parallel electrical circuit to a power source, e.g., of alternating current or of direct current, e.g. a battery mounted to the woven fibrous body. The electrical conductor elements are woven into the second regions of the woven fibrous body, e.g., with the non-conductive warp yarns or with the non-conductive filling or weft yarns. The electrical conductor elements comprise at least two yarns. The electrical conductor elements, at least in part, are applied as a conductive paste. The electrical conductor elements comprise a conductive wire. The electrical conductor elements, at least in part, are applied as a conductive hot melt adhesive. The electrical conductor elements comprise a conductive yarn or a conductive thread. The electrical conductor elements are attached upon a surface in a second region of the woven fibrous body. The electrical conductor elements are attached: by stitching, e.g. embroidery stitching, by sewing, by adhesive, by laminating, by mechanical fastening, and/or by strain relief fastening. The electrical conductance heating element has the form of a conductive yarn comprising a core, an electrical conductance heating filament, a sheath material wrapped about the core, and/or an overwrap comprising insulating material wrapped about the core and the sheath. In one embodiment, the core may comprises the electrical conductance heating element and the sheath comprises insulating material. In another embodiment, the core comprises insulating material and the sheath wrapped about the core comprises the electrical conductance heating element. The electrical conductance heating element may instead have the form of a conductive yarn comprising an electrical conductance heating filament. The electrical conductance heating element has electrical resistivity in the range of about 0.1 ohm/cm to about 500 ohm/cm.

According to one aspect of the invention, a woven fibrous article adapted to generate heat upon application of electrical power is formed by a method comprising the steps of: joining a set of non-conductive warp yarns and a set of non-conductive filling or weft yarns to form a woven fibrous body, one of the set of non-conductive warp yarns and the set of non-conductive filling or weft yarns in one or more first regions comprising relatively more coarse yarns and in one or more second regions comprising relatively more fine yarns and the other of the set of non-conductive warp yarns and the set of non-conductive filling or weft yarns in the one or more first regions and in the one or more second regions comprising relatively more fine yarns, joining, in the woven fibrous body, with the other of the set of non-conductive warp yarns and the set of non-conductive filling or weft yarns, the plurality of spaced apart electrical conductance heating elements in the form of conductive elements, to extend generally between opposite second regions of the woven fibrous body, and connecting the plurality of spaced apart electrical conductance heating elements to electrical conductor elements extending generally along the second regions of the woven fibrous body to form a parallel electrical circuit for connection to a source of electrical power.

Preferred embodiments of this aspect of the invention may include the following additional feature. The method further comprises the step of: finishing relatively more coarse yarns fibers in the one or more first regions of the set of the non-conductive warp yarns and the set of non-conductive filling or weft yarns in a manner to avoid damage to electrical conductivity performance of the conductive elements joined with the other of the set of non-conductive warp yarns and the set of non-conductive filling or weft yarns of the woven fibrous body.

According to yet another aspect of the invention, a method of forming a woven fibrous article adapted to generate heat upon application of electrical power comprises the steps of: joining a set of non-conductive warp yarns and a set of non-conductive filling or weft yarns to form a woven fibrous body, one of the set of non-conductive warp yarns and the set of non-conductive filling or weft yarns in one or more first regions comprising relatively more coarse yarns and in one or more second regions comprising relatively more fine yarns and the other of the set of non-conductive warp yarns and the set of non-conductive filling or weft yarns in the one or more first regions and in the one or more second regions comprising relatively more fine yarns, joining, in the woven fibrous body, with the other of the set of non-conductive warp yarns and the set of non-conductive filling or weft yarns, the plurality of spaced apart electrical conductance heating elements in the form of conductive elements, to extend generally between opposite second regions of the woven fibrous body, and connecting the plurality of spaced apart electrical conductance heating elements to electrical conductor elements extending generally along the second regions of the woven fibrous body to form a parallel electrical circuit for connection to a source of electrical power.

Preferred embodiments of this aspect of invention may include one or more of the following additional features. The method further comprises the steps of: finishing relatively more coarse yarns fibers in the one or more first regions of the set of the non-conductive warp yarns and the set of non-conductive filling or weft yarns in a manner to avoid damage to electrical conductivity performance of the conductive elements joined with the other of the set of non-conductive warp yarns and the set of non-conductive filling or weft yarns of the woven fibrous body. The method further comprises the step of connecting the conductive element to a source of electric power and generating heat. The method further comprises the step of connecting the conductive element to a source of electric power comprising alternating current and generating heat. The method further comprises the step of connecting the conductive element to a source of electric power comprising direct current, e.g. in the form of a battery, which may be mounted to the woven fibrous article, and generating heat. The method further comprises the step of rendering elements of the woven fibrous body hydrophilic or rendering elements of the woven fibrous body hydrophobic.

Objectives of the invention include to provide woven, fibrous electric heating articles, e.g. electric blankets, heating and warming pads, heated garments, etc., into which a plurality of spaced-apart electric conductance heating members, in the form of conductive elements, are joined with non-conductive yarns or fibers. The woven fibrous body of the heating article is subsequently subjected to a finishing process, e.g., relatively more coarse non-conductive yarns in selected (first) regions at one or both surfaces of the body may be napped, brushed, sanded, etc., in a manner to avoid damage to electrical conductance of the electric conductance heating elements, to form fleece. In a planar structure, such as an electric heating blanket, the electric conductance heating members are connected at their ends, e.g., in selected (second) regions of relatively more fine yarns along opposite selvedge or edge regions, or in spaced regions at opposite edges of first regions, of the planar body, i.e., of the blanket, and may be powered by alternating current or direct current, e.g., by one or more batteries mounted to the body of the woven fibrous heating/warming article.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 5 is a perspective view of another embodiment of a woven fibrous electric heating article of the invention in the form of an electric stadium blanket; and FIGS. 6, 6A and 6B are end section views of the woven fibrous electric heating article of FIG. 5, without a raised surface (FIG. 6), with fleece formed on one surface (FIG. 6A), and with fleece formed upon both surfaces (FIG. 6B).

FIG. 9 is a somewhat diagrammatic end section view of a preferred embodiment of an electric conductance heating yarn for a woven fibrous electric heating article of the invention, while

Like reference symbols in the various drawings indicate like elements.

DETAILED DESCRIPTION

Figure 1:
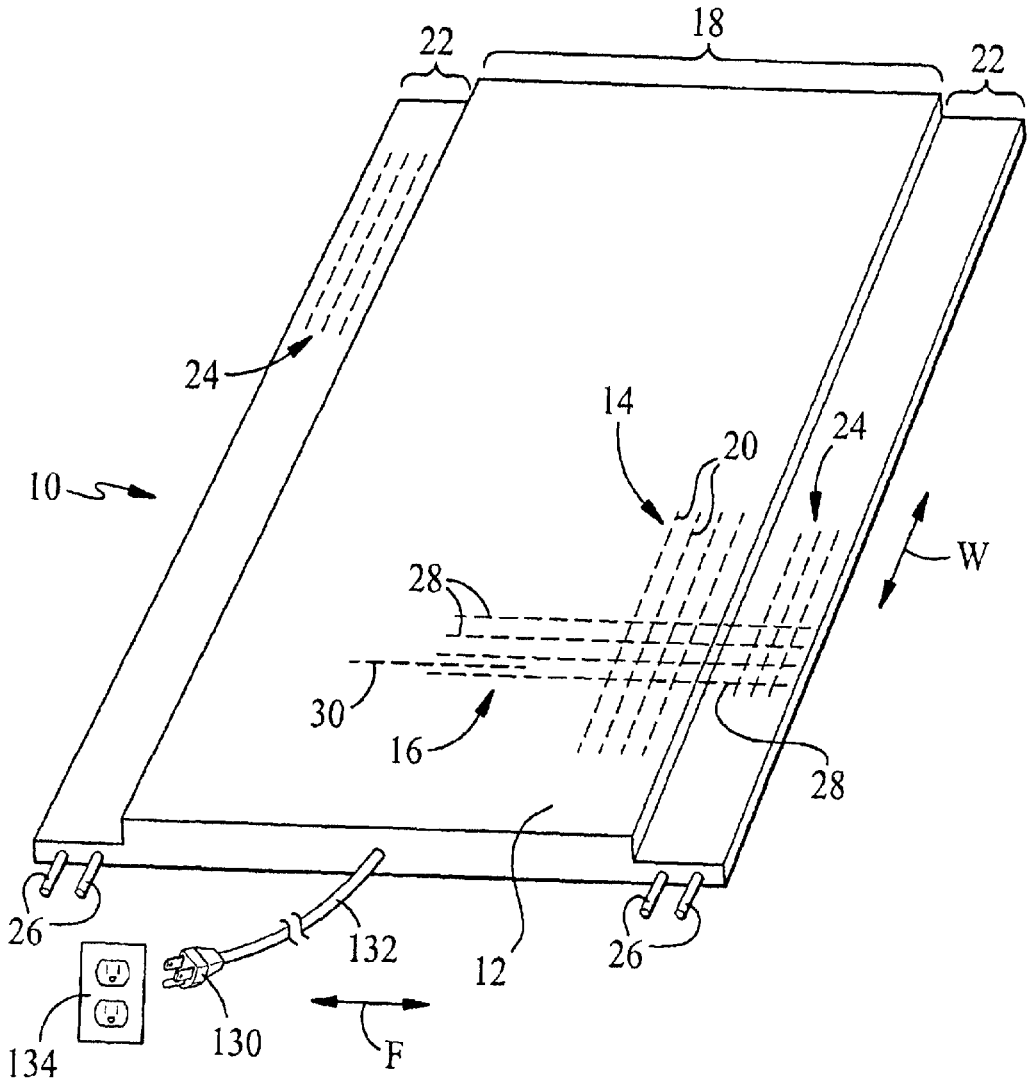
FIG. 1 is a perspective view of a woven fibrous electric heating article of the invention, e.g., in the form of an electric blanket or an electric mattress pad.
Figure 2:
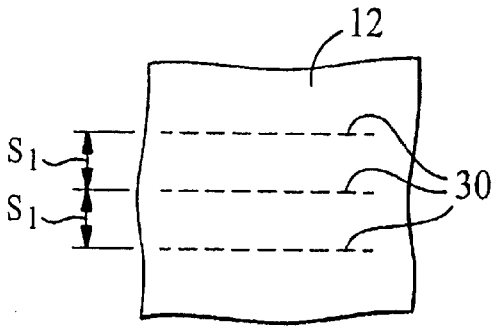
FIGS. 2 and 3 are enlarged top plan views of selected regions of the woven fibrous electric heating article of FIG. 1, showing electrical conductance heating elements placed with predetermined symmetrical spacing and asymmetrical spacing, respectively.
Figure 3:
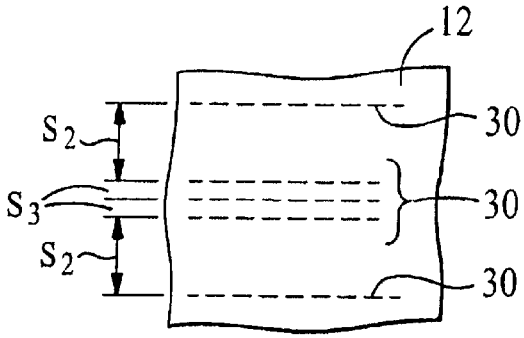

Referring to FIG. 1, in a first embodiment, a woven fibrous article 10 of the invention, e.g., an electric blanket or an electric mattress pad, is adapted to generate heat upon application of electrical power. The woven fibrous article consists of a woven body 12 formed of a set 14 of non-conductive yarns extending in the warp direction (arrow, W) woven with a set 16 of non-conductive yarns extending in the weft or filling direction (arrow, F). In this first embodiment, the set 14 of non-conductive warp yarns, in a first or central region 18, consists of relatively more coarse yarns 20 formed of filaments or spun fibers made of non-conducting insulating material, e.g., such as polyester, acrylic, nylon, cotton, wool, or the like, and the set 16 of non-conductive warp yarns, in one or more second regions, e.g., edge or selvedge regions 22, consists of relatively finer yarns 24 formed of filaments or spun fibers. A conductive bus 26, e.g., a single yarn or multiple yarns in parallel (as shown), to further reduce resistance, extends along the edge or selvedge regions 22. Still in this first embodiment, the set 16 of non-conductive filling or weft yarns consists of relatively finer yarns 28 formed of filaments or spun fibers made of non-conductive insulating materials, e.g., such as polyester, acrylic, nylon, cotton, wool, or the like, and electrical conductance heating yarns 30 placed with predetermined spacing. For example, the electrical conductance heating yarns 30 may be spaced apart symmetrically (e.g., spacing, $S_1$, FIG. 2) and/or the electrical conductance heating yarns 30 may be spaced apart asymmetrically, with varying spacing (e.g., spacing, $S_2$ and $S_3$, FIG. 3), in order to generate different amounts of heat in different predetermined regions. The electrical conductance heating yarns 30 may also be made of yarns of relatively different linear resistance spaced apart symmetrically and/or asymmetrically, again to generate different amounts of heat in different predetermined regions. The spacing is typically a function, e.g., of the requirements of heating, energy consumption and heat distribution in the article to be formed. For example, the spacing of electrical conductance heating yarns 30 may be in the range of from about 0.02 inch to about 2.5 inches. However, other spacing may be employed, depending on the conditions of intended or expected use, including the resistivity of the conductive yarns.

Figure 4:
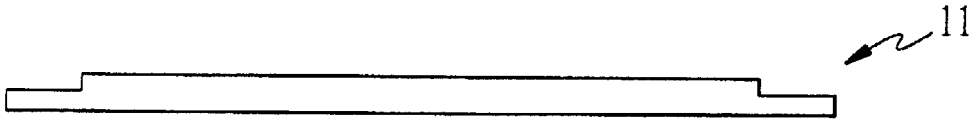
FIGS. 4, 4A and 4B are end section views of different embodiments of woven fibrous electric heating articles of the invention, without a raised surface (FIG. 4), with fleece formed on one surface (FIG. 4A), and with fleece formed upon both surfaces (FIG. 4B).

According to one preferred embodiment of the invention, the woven fibrous body 12 incorporating the electric conductance heating elements 30 can be completed in an unfleeced state, e.g., for use as an electric mattress pad 11, as shown in FIG. 4, or the like.

Figure 4A:
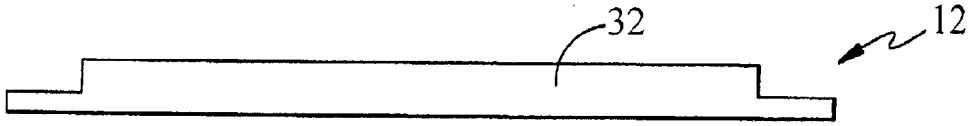
Figure 4B:
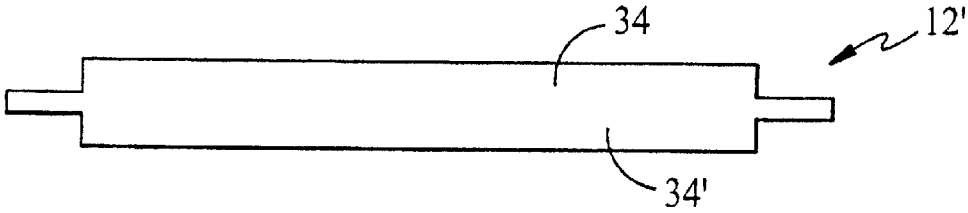

Alternatively, according to other preferred embodiments of the invention, the woven fibrous body 12 incorporating the electric conductance heating elements 30 may next be subjected to finishing, e.g., sanding, brushing, napping, etc., to generate a fleece or raised surface. For example, fleece 32 may be formed on one surface of the woven body 12 (FIG. 4A), or fleece 34, 34' may be formed on both surfaces of the woven body 12' (FIG. 4B). In either case, the process of generating fleece on the surface or surfaces of woven body is preferably performed in a manner to raise the relatively more coarse yarns 20 in the first region 18, while the relatively finer warp yarns 24 with the conductive bus 26 in the second regions, as well as the relatively finer, tight weft or filling yarns 28 (e.g., high level of twist, high level of tie down), are not raised. The finishing process is also conducted in a manner to avoid damage to the electrical conductance heating yarns 30, like those made with stainless steel filaments, that are part of the construction of the woven body 12 in the weft or filling direction (arrow, F). In particular, fleece 32 (or fleece 34, 34') is formed in a manner that avoids damage to the conductive filaments of the electrical conductance heating yarns 30 that would result in an increase in resistance to the point of creating an undesirable local hot spot, or would sever electrical conductance heating yarns 30 completely, which could result in undesirable increased electrical flow elsewhere in the circuit. The material of the woven body 12 may also be treated, e.g. chemically, to render the material hydrophobic or hydrophilic.

Referring to FIG. 5, in a second embodiment of a woven fibrous article of the invention, e.g., an electrical stadium blanket 40, or other electrical blanket, adapted to generate heat upon application of electrical power, a woven body 42 is formed of a set 44 of non-conductive yarns extending in a warp direction (arrow, W) and a set 46 of non-conductive yarns extending in a weft or filling direction (arrow, F). In this second embodiment, the set 44 of non-conductive warp yarns consists of relatively finer yarns 48 formed of filaments or spun fibers made of non-conductive insulating materials, e.g., such as polyester, acrylic, nylon, cotton, wool, or the like, and electrical conductance heating yarns 50 spaced apart with predetermined spacing. (As described above, the electrical conductance heating yarns 50 may be spaced apart symmetrically and/or the electrical conductance heating yarns 50 may be spaced apart asymmetrically, in order to generate different amounts of heat in different predetermined regions, and/or the electrical conductance heating yarns 50 may be made of yarns of relatively different linear resistance, spaced apart symmetrically or asymmetrically, again to generate different amounts of heat in different predetermined regions.) Still in this second embodiment, the set 46 of non-conductive filling or weft yarns, in a first or central region 54, consists of relatively more coarse yarns 52 formed of filaments or spun fibers made of non-conducting insulating materials, e.g., such as polyester, acrylic, nylon, cotton, wool, or the like, and the set 46 of non-conductive filling or weft yarns, in one or more second regions, e.g., edge or selvedge regions 58, consists of relatively finer yarns 60 formed of filaments or spun fibers. Conductive yarns or buses 62, formed, e.g., of one yarn (as shown) or multiple yarns in parallel, extend along the edge or selvedge regions 58.

As described above, the woven fibrous body 42 incorporating the electric conductance heating elements 50 may be completed in the form of an electrical blanket 41 in its unfleeced state (FIG. 6). Alternatively, it may next be subjected to finishing, e.g., sanding, brushing, napping, etc., to generate a fleece. Fleece 64 may also be formed on one surface of the woven body 43 (FIG. 6A), or fleece 66, 66' may be formed on both surfaces of the woven body 43' (FIG. 6B). In either case, the process of generating the fleece on the surface or surfaces of woven body is preferably performed in a manner to raise the relatively more coarse yarns 52 in the first region 54, while the relatively finer weft or filling yarns 60 with the conductive bus 62 in the second regions, as well as the relatively finer, tight warp yarns 48 (e.g., high level of twist, high level of tie down), are not raised. The finishing process is also conducted in a manner to avoid damage to the electrical conductance heating yarns 50, like those made with stainless steel filaments, that are part of the construction of the woven body 42 in the weft or filling direction (arrow, F). In particular, the fleece 64 (or fleece 66, 66') is formed in a manner that avoids damage to the conductive filaments of the electrical conductance heating yarns 50.

Figure 7:
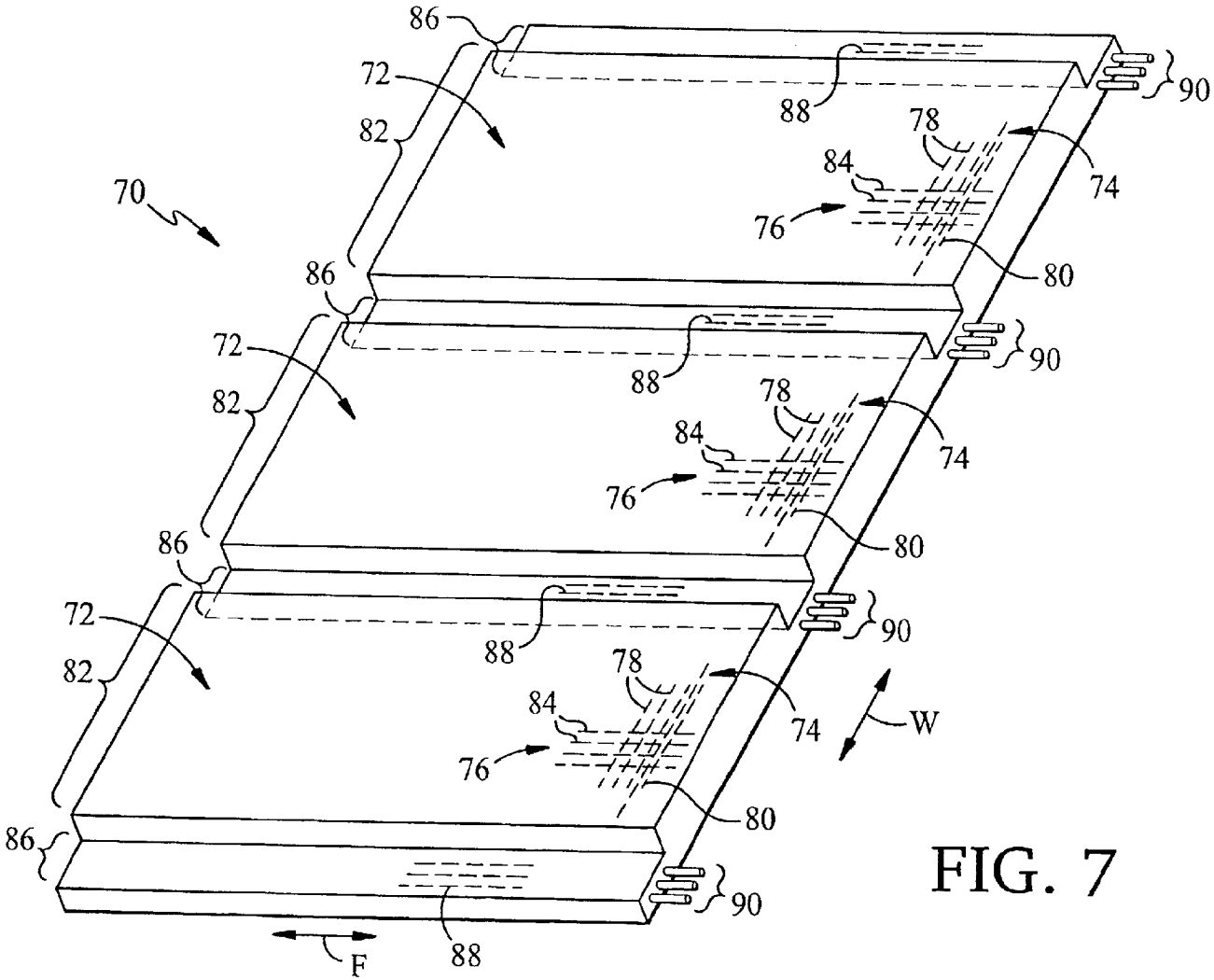
FIG. 7 is a perspective view of still another embodiment of a woven fibrous electric heating article of the invention in the form of an electric heating pad.

Referring to now to FIG. 7, in a further embodiment of a woven fibrous article of the invention, e.g., an electric heating pad 70, adapted to generate heat upon application of electrical power, a woven body 72 is formed of a set 74 of non-conductive yarns extending in the warp direction (arrow, W) and a set 76 of non-conductive yarns extending in the filling or weft direction (arrow, F). In this embodiment, the set 74 of non-conductive warp yarns consists of relatively fine yarns 78 formed, e.g., of filament 30–500 denier like polyester, nylon, polypropylene, or spun yarn made of 60/1 to 5/1 cotton count like synthetic acrylic, polyester, nylon, or natural fibers like cotton, wool or regenerated fiber like rayon, and electrical conductance heating yarns 80 spaced apart with predetermined spacing, e.g., as described above with respect to other embodiments of the invention. The electrical conductance heating yarn can be used alone as part of the warp yarn, or plaited with another warp insulator yarn during the weaving. The set 76 of non-conductive filling or weft yarns, in sequential first or central regions 82, arrayed in the warp direction (arrow, W), consists of relatively more coarse yarns 84 formed, e.g., of coarse spun yarn 1/1 to 20/1 cotton count or coarse filament yarn 300 to 5000 denier. The fibers are formed of insulating materials or like, such as synthetic fibers; polyester, nylon, acrylic, polypropylene or natural fibers; cotton, wool, or regenerated fiber like rayon. The fibers may also be a blend. At predetermined distances along the length of the fabric, in second regions 86 extending in the weft or filling direction (arrow, F) along the borders of the first regions 82, the set 76 of non-conductive weft or filling yarns consists of relatively finer yarns 88 formed, e.g., of finer filling yarn, preferred with higher twist and higher tie down (tucking), in filament or spun yarn. At each second region 86, conductive buses 90, formed by insertion of relatively low resistance electrically conductive yarns, e.g., group of yarns separated by insulator yarns 88, to further reduce resistance, as weft or filling yarns, extending along the second regions in the weft or filling direction.

Figure 8:
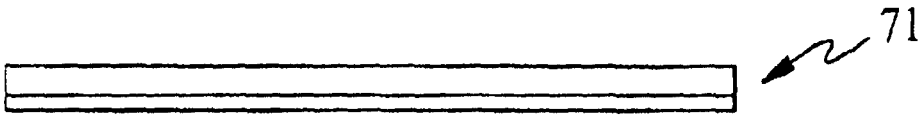
FIGS. 8, 8A and 8B are end section views of the woven fibrous heating article of FIG. 7, without a raised surface (FIG. 8), with fleece formed on one surface (FIG. 8A), and with fleece formed upon both surfaces (FIG. 8B).
Figure 8A:
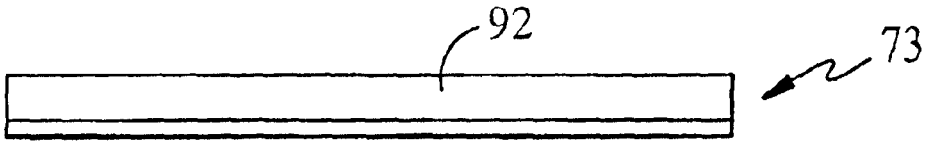
Figure 8B:
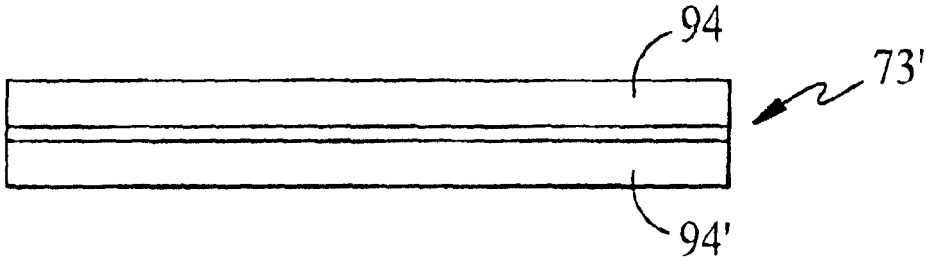

Once again, as described above, the woven fibrous body 72 incorporating the electric conductance heating elements 80 may be completed in the form of an electrical heating pad 71 in its unfleeced state (FIG. 8). Alternatively, it may next be subjected to finishing, e.g., sanding, brushing, napping, etc., to generate a fleece. Fleece 92 may also be formed on one surface of the woven body 73 (FIG. 8A), or fleece 94, 94' may be formed on both surfaces of the woven body 73' (FIG. 8B). In either case, the process of generating the fleece on the surface or surfaces of woven body is preferably performed in a manner to raise the relatively more coarse weft or filling yarns 84 in the first regions 82, while the relatively finer weft or filling yarns 88 with the conductive bus 90 in each of the second regions 86, as well as the relatively finer, tight warp yarns 78 are not raised. The finishing process is also conducted in a manner to avoid damage to the electrical conductance heating yarns 80, like those made with stainless steel filaments, that are part of the construction of the woven body 72 in the warp direction (arrow, W).

Figure 9:
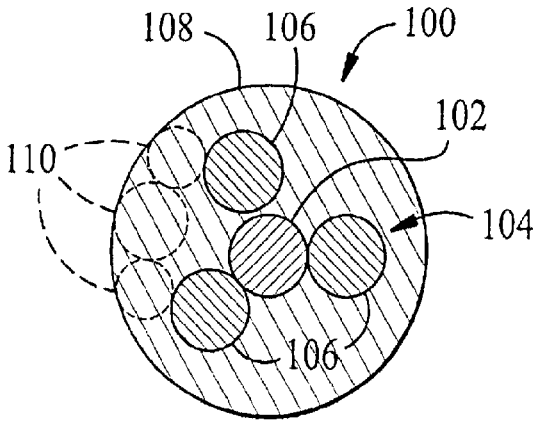

Referring to FIG. 9, in one preferred embodiment, e.g., as described above with respect to the electric blanket 10 of FIG. 1, the conductive yarn 100 forming the electrical conductance heating elements 30 consists of a core 102 of insulating material, e.g. a polyester yarn, about which extends an electrical conductive element 104, e.g. three filaments 106 of stainless steel wire (e.g. b 316L stainless steel) wrapped helically in a sheath about the core 102, and an outer covering or overwrap 108 of insulating material, e.g. polyester yarns 110 (only a few of which are suggested in the drawings) helically wrapped about the core 102 and the filaments 106 of the electrical conductive element 30. The conductive yarn 100 is available, e.g., from Bekaert Fibre Technologies, Bekaert Corporation, of Marietta, Ga., as yarn series VN14.

Figure 10:
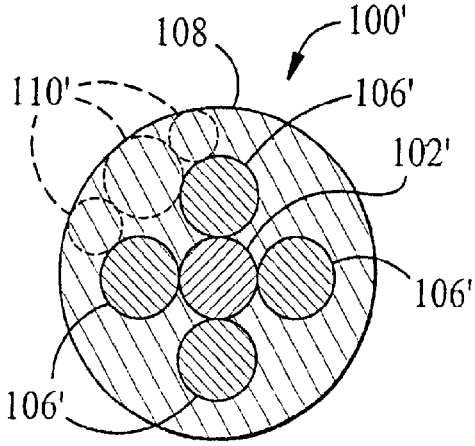
FIGS. 10–13 are similar views of alternative embodiments of electric conductance heating elements for woven fibrous electric heating articles of the invention.
Figure 11:
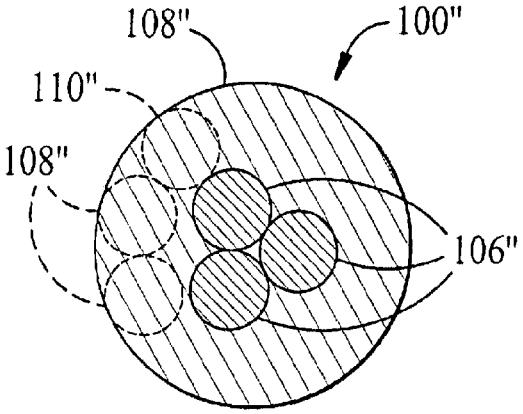
Figure 12:
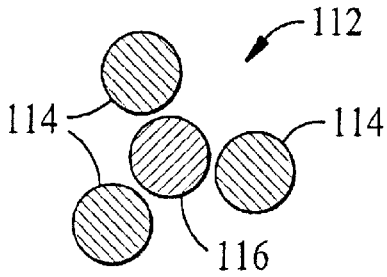
Figure 13:
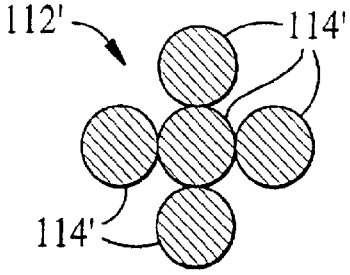

The number of conductive filaments in the conductive yarn, and the positioning of the conductive filaments within the conductive yarn, are dependent, e.g., on end use requirements. For example, in alternative configurations, in FIG. 10, a conductive yarn 100' has four conductive filaments 106' wrapped as a sheath about a non-conductive core 102' with a non-conductive outer covering or overwrap 108' of polyester yarns 110'. In FIG. 11, a conductive yarn 100" has a conductive core of three filaments 106" wrapped in a non-conductive outer sheath 108" of polyester yarns 110", without an overwrap. Referring to FIGS. 12 and 13, and also referring to FIG. 1, in other embodiments, conductive yarns 112, 112', respectively, are formed without an outer covering about the conductive filaments 114, 114'. The conductive filaments 114 may be wrapped in a sheath about a non-conductive core 116 (FIG. 12), or the conductive filaments 114' may be in the form of a twisted stainless steel wire (FIG.

13). In these embodiments, the non-conductive warps yarns 20, 24 and the non-conductive weft or filling yarns 28 of the woven body 12, in particular, the relatively more coarse yarns, either fleeced or unfleeced, serve to insulate the conductive yarns 112, 112' in the woven fibrous heating/warming fabric article.

The resistivity of the conductive yarn 30 can be selected in the range of, e.g., from about 0.1 ohm/cm to about 500 ohm/cm, on the basis of end use requirements of the woven fibrous article. However, conductive yarns performing outside this range can also be employed, where required or desired. Referring again, by way of example, to FIG. 9, the core 102 of the conductive yarn and the sheath material 108 of the outer covering over the conductive filaments 106 may be made of synthetic or natural material. The outer covering 108 may also have the form of a sleeve, e.g. a dip-coated or extruded sleeve. Conductive yarns of different constructions suitable for use according to this invention can also be obtained from Bekaert Fibre Technologies.

Figure 14:
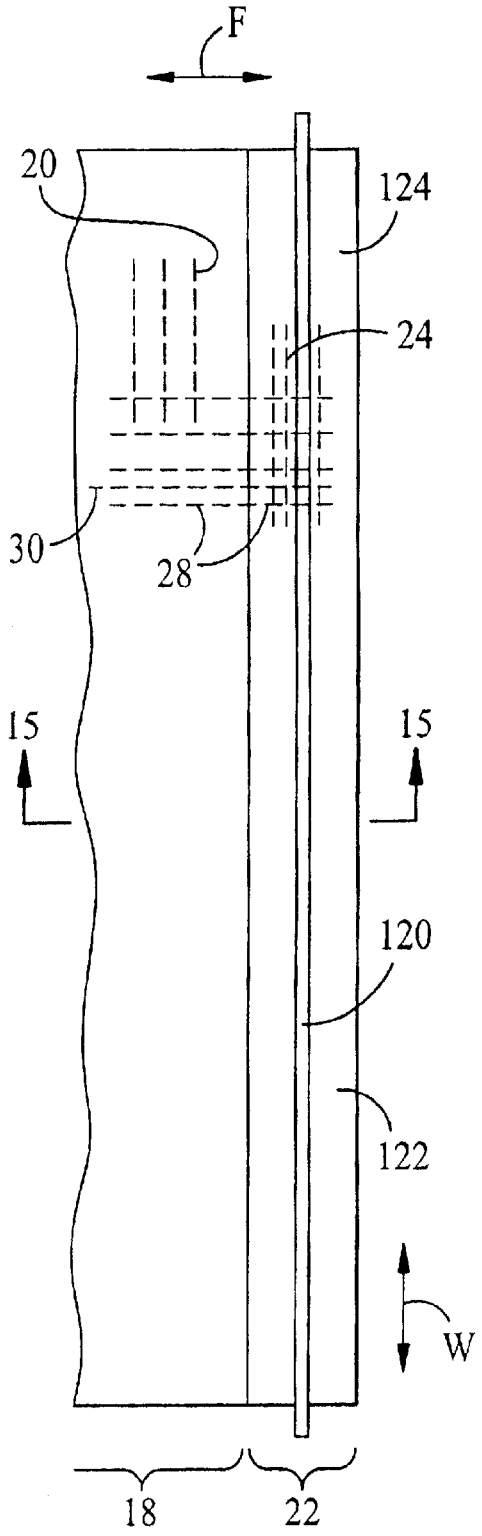
FIG. 14 is a top plan view of an edge region of an alternative embodiment of a woven fibrous electric heating article of the invention, with a conductive bus attached externally in an edge region.
Figure 15:
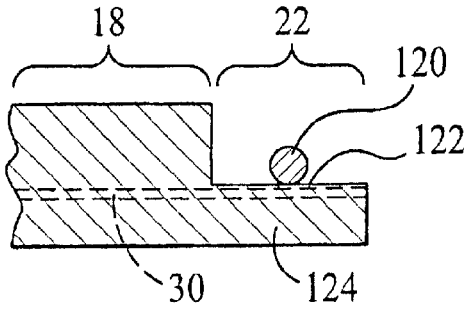
FIG. 15 is an end section view of the edge region of a woven fibrous electric heating article of the invention taken at the line 15—15 of FIG. 14.

Referring now to FIGS. 14 and 15, and also with reference to FIG. 1, use of relatively finer yarns 24, 28 in the edge or selvedge regions 22, in the warp and weft or filling directions, respectively, e.g., as compared to the coarse yarns 20 of the first region 18, alternatively permits use of conductive buses 120 that are appended externally, e.g. along the surfaces 122 of the edge or selvedge regions 22. It also provides for external securing of the connection between the electrical conductance heating yarns 30 and the external conductive buses 120. For example, after finishing, and after the woven body is heat set for width, conductive buses 120 are provided in opposite edge regions 22 to connect spaced apart electrical conductance heating yarns 30, in parallel, to a source of electrical power, thereby to complete the electrical circuit. The conductive buses 120 may be formed or attached upon either surface, or upon both surfaces, of the woven body 124.

Figure 16:
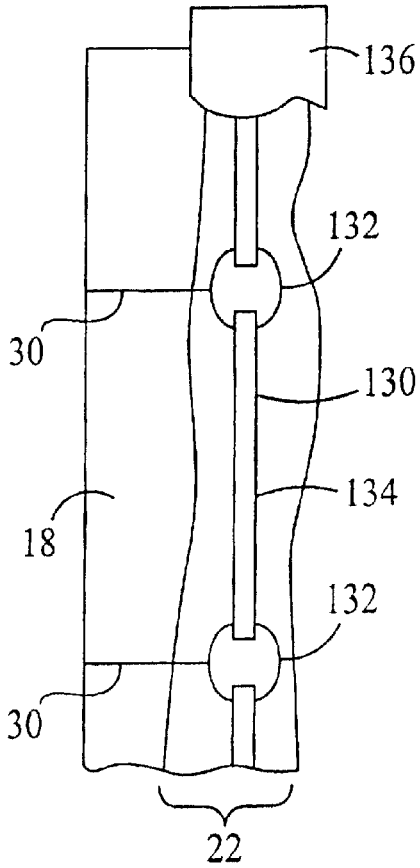
FIG. 16 is a top plan view of an edge region of another alternative embodiment of a woven fibrous electric heating article of the invention, with a conductive bus attached externally in an edge region.

Alternatively, the conductive bus 120 may instead be applied before, or in the absence of, finishing (and/or before heat setting), since the conductive buses 120 are advantageously located in the second edge or selvedge regions 22 of the relatively finer yarns 24, 28 (which are not finished), and not in a first or central region 18 of the relatively more coarse yarns 20. Any suitable method may be used to complete the circuit. For example, the conductive buses 120 may consist of one conductive yarn, e.g., with a resistivity of, e.g., 0.1 to 100 ohm per meter, or of multiple (e.g. two or more) conductive yarns, thus to reduce resistance and to ensure a more positive connection between the electric conductance heating elements and the conductive buses. The conductive bus 120 may, at least in part, be applied in the form of a conductive paste, e.g. such as available commercially from Loctite Corporation, of Rocky Hill, Conn. The conductive paste may be applied as a stripe to a surface of the woven body 124 in electrical conductive relationship with the electrical conductance heating elements 30, and then connected to the power source. (If necessary, the conductive filaments of the electrical conductance heating elements 30 may be exposed, e.g., a covering yarn may be removed with solvent or localized heat, e.g. by laser; or the covering yarn may be manually unraveled, thus to facilitate accessibility to conductive filaments of each of the electrical conductance heating yarns.) More preferably, the conductive buses 120, in the form of conductive yarn or thread, are attached upon the surface 122 of the woven body 124, e.g., by stitching, e.g. embroidery stitching, sewing, or with an adhesive, such as by laminating. Alternatively, referring to FIG. 16, and again with reference to FIG. 1, the conductive bus 130 may consist of localized dots or regions 132 of conductive paste applied in electrical contact with exposed conductive filaments of the electric conductance heating yarns 30, with a conductive metal wire 134 disposed in electrical conductive contact with, and extending, preferably continuously, between, the localized conductive paste regions 132. The electric conductive bus 130 may thereafter be covered by a layer of fabric material 136 joined to overlay a portion or substantially all of the surface of the selvedge regions 122 of the woven body 124, e.g., in the form of a cloth trim or edging material attached, e.g., by stitching along the edge of the woven body 124, or in the form of a second layer of fabric joined to woven body 124, e.g., by stitching or lamination.

A conductive bus of the woven fibrous electric heating article of the invention is preferably flexible, corrosion resistant, with low electrical resistivity, e.g. 0.1 ohm/meter to 100 ohm/meter, and mechanically durable. Other considerations include cost, availability in the market, and ease of fabrication. The conductive bus may thus have the form of a wire, e.g., stranded, twisted, or braided; a conductive-coated textile, e.g., a coated filament or fabric, or a woven ribbon; a foil tape, e.g., adhesive backed, with or without a conductive backing; a conductive-filled resin, e.g., disposed in a continuous line; or a hybrid textile, e.g., including tinsel wire or stainless steel filaments, in twisted, braided, stranded, woven or knitted configuration. As mentioned above, the conductive bus may also have the form of a single yarn, or two or more generally parallel yarns, woven into or stitched upon the fabric body, or a tape or band of conductive material attached upon the surface of the fabric. In a presently preferred form, the conductive bus may be a narrow woven element, incorporating silver-coated copper tinsel wire, either multi-strand or individual strands in parallel, with periodic floats provided for contact with the conductive yarns, or a narrow woven element pre-coated with conductive thermoplastic in a stripe pattern, with discontinuous diagonal stripes to provide flexibility and ensure registration with conductive yarns. The conductive bus may also extend in multiple elements extending generally parallel in the edge region of the fabric, with similar or different lengths, to connect to distinct sets of electrical conductance heating yarns, in this manner reducing the level of electrical current carried by each conductive bus in the region close to the source of electrical power. In the case of conductive buses of different lengths, the resistivity of the individual conductive buses may be different.

The conductive bus 120 is preferably mounted upon the surface of the woven body 124 in a manner to provide strain relief For example, strain relief attachment may be provided by sewing the conductive bus 120 to the woven body 124, by tacking the conductive bus 120 upon the surface of the body 124 with mechanical fasteners, such as snaps, grommets, staples, or rivets; by over-molding in place strain relief injection-molded "buttons"; or by incorporating strain relief and electrical connection rigid filled resin having low viscosity. The electrical conductance heating yarns 30 and conductive bus 120 may be connected electrically by conductive welding or paste; rivets, snaps, or metal holders or fasteners; interlacing, knitting or weaving in, or combinations of the above.

Figure 17:
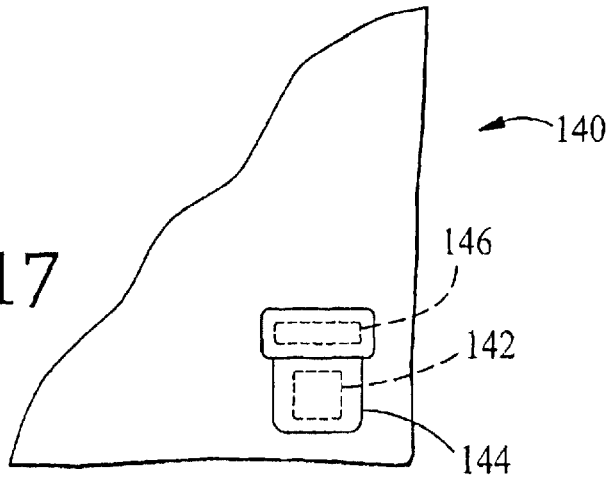
FIGS. 17, 18 and 19 are somewhat diagrammatic representations of other embodiments of woven fibrous electric heating articles of the invention, including as adapted to be powered by direct current, e.g., a stadium or camping blanket (FIG. 17) and a garment (FIG. 18), each adapted to be powered from a battery replaceably mounted to the article; and an automobile warming or heating pad (FIG. 19), adapted to be powered from an automobile battery.
Figure 18:
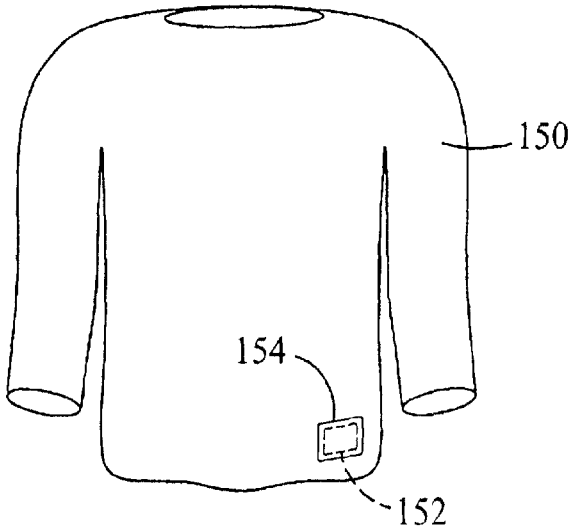
Figure 19:
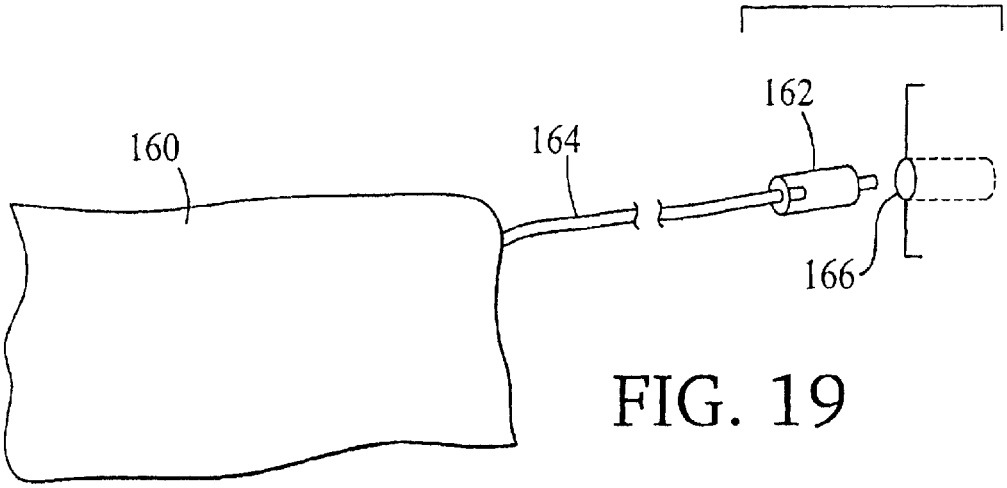

The completed circuit is next connected to a power source to supply electrical power to the electrical conductance heating elements for the required amount of heat generation. For example, referring to FIG. 1, a woven fibrous article 10 of the invention (an electric blanket) is adapted for connection to a source of alternating current by means of plug 130 on cord 132 for insertion in household outlet 134. Referring to FIGS. 17 and 18, a stadium or camping blanket 140 and a garment 150 of the invention each includes a source of direct current, i.e. a battery pack 142, 152, respectively, e.g., as available from Polaroid Corporation, of Cambridge, Mass., replaceably mounted to the heating/warming fabric article, e.g. in a pocket 144, 154, respectively. Referring to FIG. 17, the pocket may be secured by a hook-and-loop type fastener 146. Preferably, for certification by Underwriters Laboratories Inc. (UL®), the voltage supplied by the power source to the electrical conductance heating elements is lower than 25 volts, e.g. a Class II UL® certified transformer may be used to step down a 110 v power supply to 25 volts or under. Referring next to FIG. 19, a warming or heating pad 160 of the invention, e.g. for an automobile seat, is adapted for connection to a source of direct current by means of plug 162 on cord 164 for insertion into the cigarette lighter or other power outlet 166 of an automobile.

The resulting product is a woven fibrous electric heating article, e.g., an electric blanket 90 inches by 90 inches with a 24-volt power supply, with features not available with blankets currently on the market. In a preferred embodiment, the fibrous woven article has the characteristics of being: flexible, foldable, portable, able to be washed frequently, comfortable, with zone heating and low voltage (for increased safety).

A number of embodiments of the invention have been described. Nevertheless, it will be understood that various modifications may be made without departing from the spirit and scope of the invention. For example, woven fibrous electric heating articles of the invention may be formed by any suitable method that results in a woven body formed of non-conductive fibers and conductive elements capable of generating heating when connected to a source of electrical power, and, as desired, or as designed, with non-conductive fibers being exposed, e.g., in predetermined regions, for finishing at one or both surfaces to create fleece, the finishing being performed in a manner to avoid damage to electrical conductivity performance of the electrical conductance heating elements joined with the non-conductive fibers in the woven body.

Figure 20:
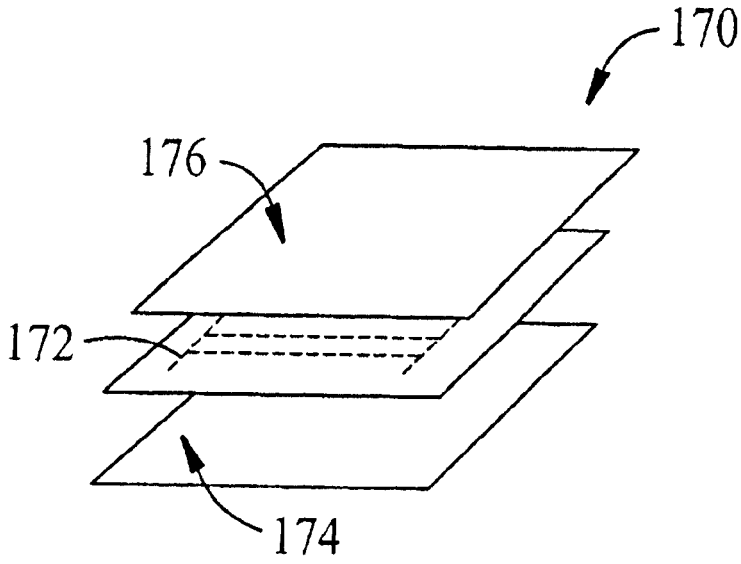
FIGS. 20 and 21 are somewhat diagrammatic perspective views of other embodiments of electric heating/warming articles of the invention formed of two or more layers.
Figure 21:
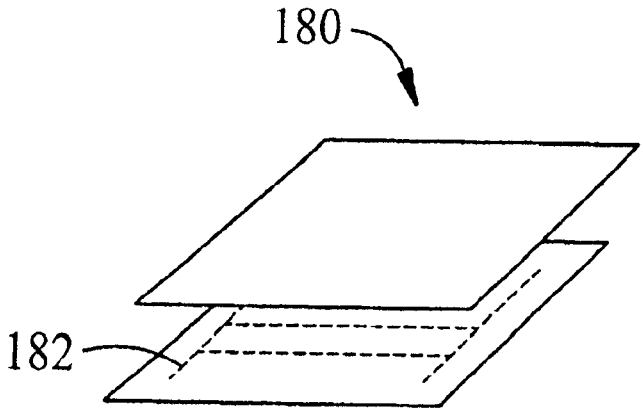

Referring to FIGS. 20 and 21, woven fibrous electric heating article of the invention may also be employed in the form of laminated devices for delivering therapeutic heat to a selected region of the human body. For example, for delivering therapeutic heat upon a relatively large surface region, e.g., of the back or thigh, the heating/warming device 170 may be in the form of a wrap or sleeve, with a woven fibrous electric heating article 172 of the invention disposed between opposite fabric layers 174, 176. For delivery of heating/warming to a more local region, a heating/warming device 180 may be in a form suitable for mounting to a strap or brace with a woven fibrous electric heating article 182 of the invention laminated with a covering layer of fabric 184.

Accordingly, other embodiments are within the following claims.

What is claimed is:

1. A woven fibrous article adapted to generate heat upon application of electrical power, comprising:

a woven fibrous body comprised of a set of non-conductive warp yarns and a set of non-conductive filling or weft yarns, one of said set of non-conductive warp yarns and said set of non-conductive filling or weft yarns in one or more first regions comprising relatively more coarse yarns and in one or more second regions comprising relatively more fine yarns with electrical conductor elements extending generally along said second regions of said woven fibrous body and adapted to connect a plurality of spaced apart electrical conductance heating elements in a parallel electrical circuit to a source of electrical power, and the other of said set of non-conductive warp yarns and said set of non-conductive filling or weft yarns in the one or more first regions and in the one or more second regions comprising relatively more fine yarns, with said plurality of spaced apart electrical conductance heating elements in the form of conductive elements joined in said woven fibrous body with the other of said set of non-conductive warp yarns and said set of non-conductive filling or weft yarns to extend generally between opposite said second regions of said woven fibrous body.

2. The woven fibrous article of claim 1, where said woven fibrous article further comprises fleece upon at least one surface of said woven fibrous body, formed by finishing fibers of the relatively more coarse yarns in said one or more first regions of said one of said set of non-conductive warp yarns and said set of non-conductive filling or weft yarns in a manner to avoid damage to electrical conductivity performance of the conductive elements joined with the other of said set of non-conductive warp yarns and said set of non-conductive filling or weft yarns of said woven fibrous body.

3. The woven fibrous article of claim 2, wherein said woven fibrous body has fleece formed in said relatively more coarse non-conductive fibers upon both surfaces.

4. The woven fibrous article of claim 1, wherein, in said one or more first regions, said set of non-conducting warp yarns comprises said relatively more coarse yarns and said set of non-conducting filling or well yarns comprises said relatively more fine yarns.

5. The woven fibrous article of claim 4, wherein said one or more second regions comprises selvedge or edge regions.

6. The woven fibrous article of claim 1, wherein, in said one or more first regions, said set of non-conducting filling or well yarns comprises said relatively more coarse yarns and said set of non-conducting warp yarns comprises said relatively more fine yarns.

7. The woven fibrous article of claim 6, wherein said one or more second regions comprises spaced regions with one or more said first regions disposed therebetween.

8. The woven fibrous article of claim 6 or claim 7, wherein said one or more second regions comprises a plurality of spaced second regions with one or more said first regions disposed therebetween.

9. The woven fibrous article of claim 1, claim 4 or claim 6, wherein a series of at least three electrical conductance heating elements of said plurality of electrical conductance heating elements are symmetrically spaced.

10. The woven fibrous article of claim 9, wherein selected of said electrical conductance heating elements are asymmetrically spaced to provide selected localized regions of heating.

11. The woven fibrous article of claim 1, claim 4 or claim 6, wherein selected of said electrical conductance heating elements are asymmetrically spaced to provide selected localized regions of heating.

12. The woven fibrous article of claim 1, claim 4 or claim 6, wherein selected of said conductive elements have relatively lower linear resistance than other of said conductive elements, to provide selected localized regions of relatively greater heating.

13. The woven fibrous article of claim 12, wherein said selected of said conductive elements of relatively lower linear resistance are symmetrically spaced.

14. The woven fibrous article of claim 13, wherein said selected of said conductive elements of relatively lower linear resistance are asymmetrically spaced.

15. The woven fibrous article of claim 1, wherein said conductive elements have the form of a conductive yarn.

16. The woven fibrous article of claim 1, wherein said fibrous body comprises hydrophilic material.

17. The woven fibrous article of claim 1, wherein said fibrous body comprises hydrophobic material.

18. The woven fibrous article of claim 1, wherein said electrical conductor elements are adapted for connecting said plurality of spaced-apart electrical conductance heating elements in the parallel electrical circuit to a power source of alternating current.

19. The woven fibrous article of claim 1, wherein said electrical conductor elements are adapted for connecting said plurality of spaced-apart electrical conductance heating elements in the parallel electrical circuit to a power source of direct current.

20. The woven fibrous article of claim 19, wherein said power source of direct current comprises a battery.

21. The woven fibrous article of claim 20, wherein said battery is mounted to said woven fibrous body.

22. The woven fibrous article of claim 1, wherein said woven fibrous article further comprises a power source connected to said plurality of spaced apart electrical conductance heating elements by said electrical conductor elements, said power source comprising a battery mounted to said woven fibrous body.

23. The woven fibrous article of claim 1, wherein said electrical conductor elements are woven into said second regions of said woven fibrous body.

24. The woven fibrous article of claim 4, wherein said electrical conductor elements are woven into said second regions of said woven fibrous body with said non-conductive warp yarns.

25. The woven fibrous article of claim 6, wherein said electrical conductor elements are incorporated into said second regions of said woven fibrous body with said non-conductive filling or weft yarns.

26. The woven fibrous article of claim 23, claim 24 or claim 25, wherein said electrical conductor elements comprise at least two yarns.

27. The woven fibrous article of claim 1, wherein said electrical conductor elements, at least in part, are applied as a conductive paste.

28. The woven fibrous article of claim 1, wherein said electrical conductor elements comprise a conductive wire.

29. The woven fibrous article of claim 1, wherein said electrical conductor elements, at least in part, are applied as a conductive hot melt adhesive.

30. The woven fibrous article of claim 1, wherein said electrical conductor elements comprise a conductive yarn or a conductive thread.

31. The woven fibrous article of claim 1, wherein said electrical conductor elements are attached upon a surface in a said second region of said woven fibrous body.

32. The woven fibrous article of claim 31, wherein said electrical conductor elements are attached by stitching.

33. The woven fibrous article of claim 32, wherein said stitching comprises embroidery stitching.

34. The woven fibrous article of claim 31, wherein said electrical conductor elements are attached by sewing.

35. The woven fibrous article of claim 31, wherein said electrical conductor elements are attached by adhesive.

36. The woven fibrous article of claim 31, wherein said electrical conductor elements are attached by laminating.

37. The woven fibrous article of claim 31, wherein said electrical conductor elements are attached by mechanical fastening.

38. The woven fibrous article of claim 31, wherein said electrical conductor elements are attached by strain relief fastening.

39. The woven fibrous article of claim 1, wherein said electrical conductance heating element has the form of a conductive yarn comprising a core, an electrical conductance heating filament, and a sheath material wrapped about said core.

40. The woven fibrous article of claim 39, wherein said core comprises said electrical conductance heating element and said sheath comprises insulating material.

41. The woven fibrous article of claim 39, wherein said core comprises insulating material and said sheath wrapped about said core comprises said electrical conductance heating element.

42. The woven fibrous article of claim 41, wherein said electrical conductance heating element further comprises an overwrap comprising insulating material wrapped about said core and said sheath.

43. The woven fibrous article of claim 1, wherein said electrical conductance heating element has the form of a conductive yarn comprising an electrical conductance heating filament.

44. The woven fibrous article of claim 39, claim 40, claim 41, claim 42, or claim 43, wherein said electrical conductance heating element has electrical resistivity in the range of about 0.1 ohm/cm to about 500 ohm/cm.

45. A woven fibrous article adapted to generate heat upon application of electrical power, formed by a method comprising the steps of:

joining a set of non-conductive warp yarns and a set of non-conductive filling or weft yarns to form a woven fibrous body, one of the set of non-conductive warp yarns and the set of non-conductive filling or weft yarns in one or more first regions comprising relatively more coarse yarns and in one or more second regions comprising relatively more fine yarns and the other of the set of non-conductive warp yarns and the set of non-conductive filling or weft yarns in the one or more first regions and in the one or more second regions comprising relatively more fine yarns, joining, in the woven fibrous body, with the other of the set of non-conductive warp yarns and the set of non-conductive filling or weft yarns, the plurality of spaced apart electrical conductance heating elements in the form of conductive elements, to extend generally between opposite second regions of the woven fibrous body, and connecting the plurality of spaced apart electrical conductance heating elements to electrical conductor elements extending generally along the second regions of the woven fibrous body in a manner to form a parallel electrical circuit for connection to a source of electrical power.

46. The method of forming the fibrous article of claim 45, said method further comprising the step of:

finishing relatively more coarse yarns fibers in the one or more first regions of the set of the non-conductive warp yarns and the set of non-conductive filling or weft yarns in a manner to avoid damage to electrical conductivity performance of the conductive elements joined with the other of the set of non-conductive warp yarns and the set of non-conductive filling or weft yarns of the woven fibrous body.

47. A method of forming a woven fibrous article adapted to generate heat upon application of electrical power, said method comprising the steps of:

joining a set of non-conductive warp yarns and a set of non-conductive filling or weft yarns to form a woven fibrous body, one of the set of non-conductive warp yarns and the set of non-conductive filling or weft yarns in one or more first regions comprising relatively more coarse yarns and in one or more second regions comprising relatively more fine yarns and the other of the set of non-conductive warp yarns and the set of non-conductive filling or weft yarns in the one or more first regions and in the one or more second regions comprising relatively more fine yarns, joining, in the woven fibrous body, with the other of the set of non-conductive warp yarns and the set of non-conductive filling or weft yarns, the plurality of spaced apart electrical conductance heating elements in the form of conductive elements, to extend generally between opposite second regions of the woven fibrous body, and connecting the plurality of spaced apart electrical conductance heating elements to electrical conductor elements extending generally along the second regions of the woven fibrous body to form a parallel electrical circuit for connection to a source of electrical power.

48. The method of claim 47, further comprising the steps of:

finishing relatively more coarse yarns fibers in the one or more first regions of the set of the non-conductive warp yarns and the set of non-conductive filling or weft yarns in a manner to avoid damage to electrical conductivity performance of the conductive elements joined with the other of the set of non-conductive warp yarns and the set of non-conductive filling or weft yarns of the woven fibrous body.

49. The method of claim 47 further comprising the step of connecting the conductive element to a source of electric power and generating heat.

50. The method of claim 49 further comprising the step of connecting the conductive element to a source of electric power comprising alternating current and generating heat.

51. The method of claim 49 further comprising the step of connecting the conductive element to a source of electric power comprising direct current and generating heat.

52. The method of claim 51 further comprising the step of connecting the conductive element to a source of electric power comprising direct current in the form of a battery and generating heat.

53. The method of claim 52 further comprising the step of connecting the conductive element to a source of electric power comprising direct current in the form of a battery mounted to the woven fibrous article and generating heat.

54. The method of claim 47 further comprising the step of rendering elements of said woven fibrous body hydrophilic.

55. The method of claim 47 further comprising the step of rendering elements of said woven fibrous body hydrophobic.

* * * * *

UNITED STATES PATENT AND TRADEMARK OFFICE

CERTIFICATE OF CORRECTION

PATENT NO. : 6,888,112 B2 
DATED : May 3, 2005
INVENTOR(S) : Moshe Rock and Vikram Sharrma It is certified that error appears in the above-identified patent and that said Letters Patent is hereby corrected as shown below:

Column 12,
Line 42, replace "well" with -- weft --.

Signed and Sealed this

Thirteenth Day of December, 2005

JON W. DUDAS
*Director of the United States Patent and Trademark Office*